US012635818B2

(12) United States Patent
Matz

(10) Patent No.: US 12,635,818 B2
(45) Date of Patent: May 26, 2026

(54) COMBINATION BLANKET AND PILLOW SYSTEM

(71) Applicant: Lauren E Matz, Norridge, IL (US)

(72) Inventor: Lauren E Matz, Norridge, IL (US)

( * ) Notice: Subject to any disclaimer, the term of this patent is extended or adjusted under 35 U.S.C. 154(b) by 0 days.

(21) Appl. No.: 18/798,530

(22) Filed: Aug. 8, 2024

(65) Prior Publication Data

US 2026/0041262 A1 Feb. 12, 2026

(51) Int. Cl.
*A47G 9/10* (2006.01)
*A47G 9/02* (2006.01)

(52) U.S. Cl.
CPC ..... *A47G 9/1045* (2013.01); *A47G 9/0223* (2013.01)

(58) Field of Classification Search
CPC .... A47G 9/1045; A47G 9/0223; A47G 9/062; A47G 9/086; A47G 9/02; A47G 9/06; A41D 15/04; A45C 9/00; A45C 3/10; A45F 4/02; A45F 4/06; A45F 3/04; A45F 4/08; A45F 3/02; A47D 15/003; A47D 5/006; A47D 13/02; A47C 17/82; A47K 10/02
USPC .... 383/4; 5/417, 419, 420, 485, 413 R, 482, 5/502, 636, 653, 639, 904; 190/2, 1; 2/69; D6/601, 603, 596
See application file for complete search history.

(56) References Cited

U.S. PATENT DOCUMENTS 4,516,668 A * 5/1985 Grayek ..... A47G 9/062 190/126
4,991,245 A * 2/1991 Franco ..... A47G 9/062 5/490
5,099,530 A * 3/1992 Scott ..... A47G 9/02 5/500
5,730,529 A * 3/1998 Fritz ..... A47G 9/062 5/419
2006/0277681 A1* 12/2006 Mecheau ..... A47G 9/02 5/419

* cited by examiner

*Primary Examiner* — Madison Matthews
(74) *Attorney, Agent, or Firm* — IpHorgan Ltd.

(57) ABSTRACT

A combination pillow and blanket system having a first section having a pillow case forming a compartment containing a cushioning element, first and second handles on the side edges, first and second attachment mechanisms on the side edges, wherein with the first section folded in half with the two side edges adjacent one another, the first and second attachment mechanisms are releasably secured together, a mid-section extends from the first section along respective longitudinal edges, the mid-section is made of a blanket material or similar fabric, a third section extends from the mid-section along respective longitudinal edges, the third section is made of a blanket material or similar fabric, and at least one slit is formed in an area where the mid-section and third section meet.

16 Claims, 3 Drawing Sheets

COMBINATION BLANKET AND PILLOW SYSTEM

FIELD OF THE INVENTION

The present invention relates to blankets and pillows for home and travel use.

BACKGROUND OF THE INVENTION

The prior art includes the SNUGGIE blanket and similar blankets and pillows.

The prior art product is too big, not warm enough and does not travel well.

SUMMARY OF THE INVENTION

The present invention provides a combination pillow and blanket system. The system includes a first section having a top surface and a bottom surface and includes a pillow case forming a compartment, the first section generally defines two longitudinal edges and two side edges, the pillow case includes a slit formed along one of the edges, a fastener is adapted for releasably sealing the slit, a cushioning element is located within the compartment, a first handle is located at one of the side edges and a second handle is located at the other side edge, a first attachment mechanism is located at one of the side edges and a second attachment mechanism is located at the other side edge and aligned with the first attachment mechanism, wherein with the first section folded in half with the two side edges adjacent one another, the first and second attachment mechanisms are releasably secured together, a second or mid-section having a top surface and bottom surface, the mid-section generally defines two longitudinal edges and two side edges, the mid-section extends from the first section along respective longitudinal edges, the mid-section is made of a blanket material or similar fabric, a third section having a top surface and bottom surface, the third section generally defines two longitudinal edges and two side edges, the third section extends from the mid-section along respective longitudinal edges, the third section is made of a blanket material or similar fabric, and at least one slit is formed in an area where the mid-section and third section meet.

DETAILED DESCRIPTION OF THE INVENTION

Figure 1:
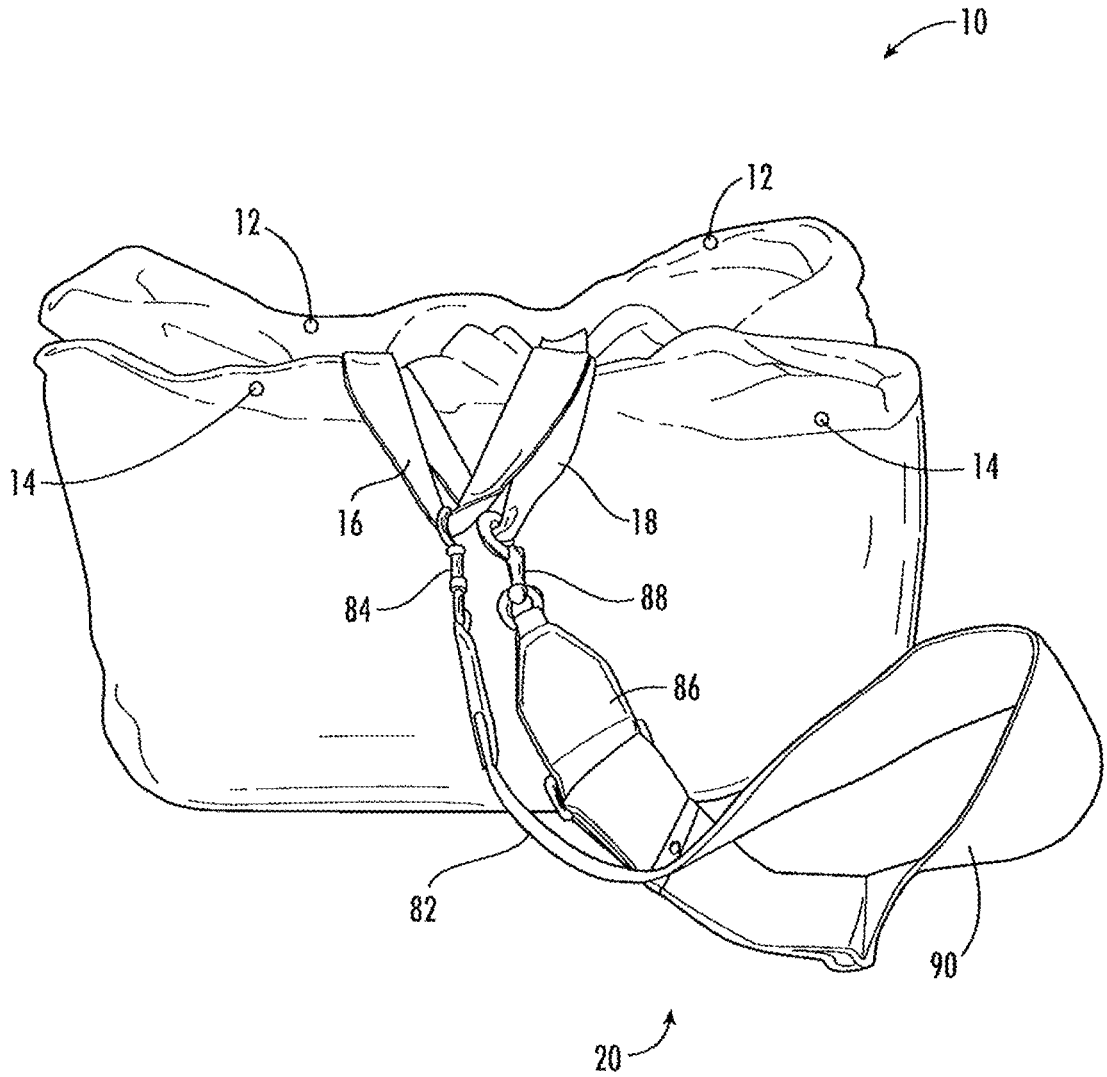
FIG. 1 is a perspective view of a combination pillow and blanket system in a folded state.

FIG. 1 is a perspective view of a combination pillow and blanket system 10 is shown in FIG. 1 in a folded state. First and second attachment mechanisms 12, 14 are shown retaining the system 10 in the folded state. First and second handles 16, 18 are secured to the system 10 and include a shoulder strap 20 secured to the handles.

Figure 2:
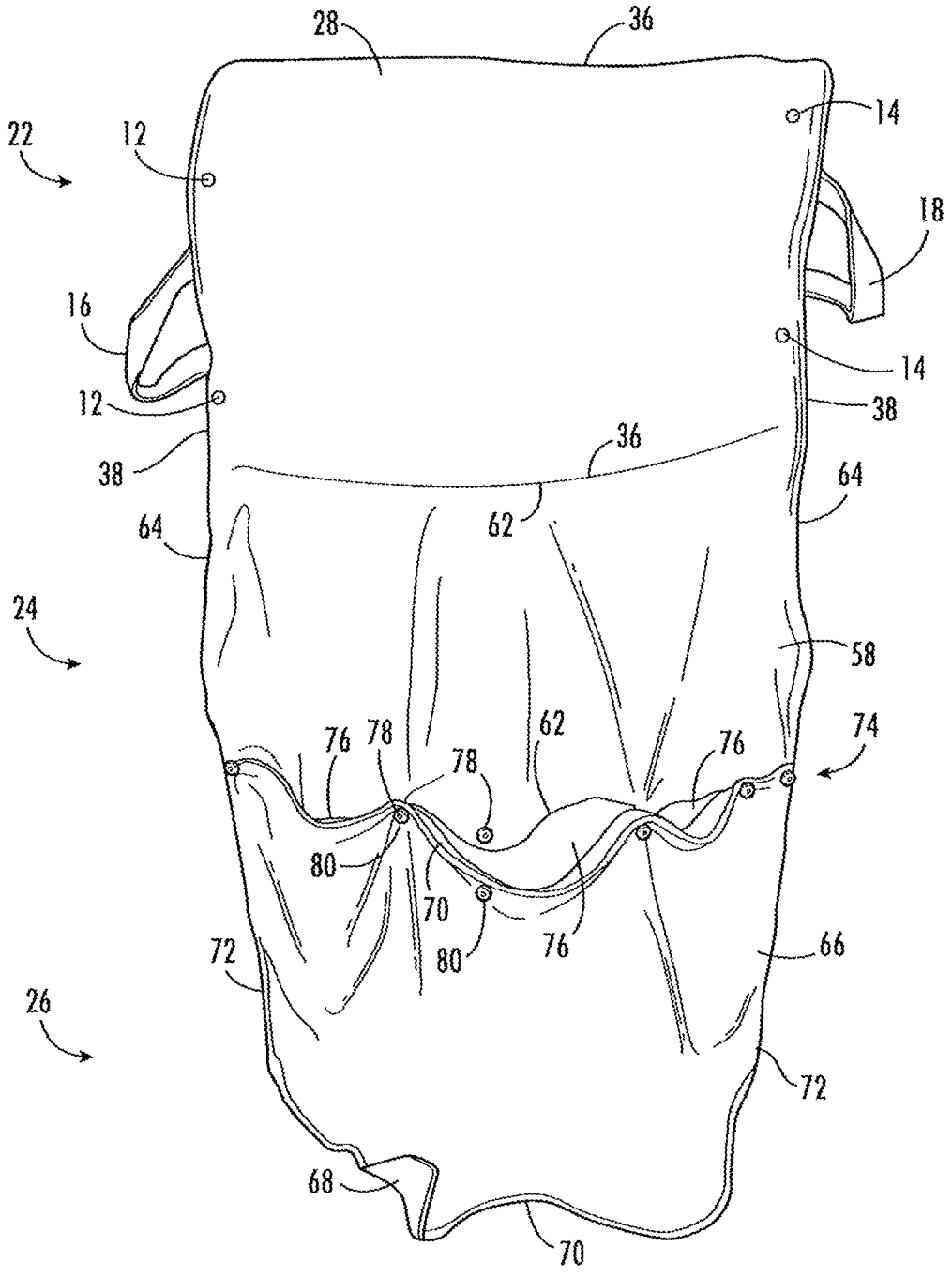
FIG. 2 is a perspective view of the combination pillow and blanket system of FIG. 1 in an opened state.

FIG. 2 is a perspective view of the combination pillow and blanket system 10 of FIG. 1 in an opened state. The system 10 includes a first section 22, a second or mid-section

24 and a third section 26. The first section 22 includes a top surface 28 and a bottom surface 30 and forms a pillow case 32 having a compartment or cavity 34. The first section 22 generally defines two longitudinal edges 36 and two side edges 38.

Figure 3:
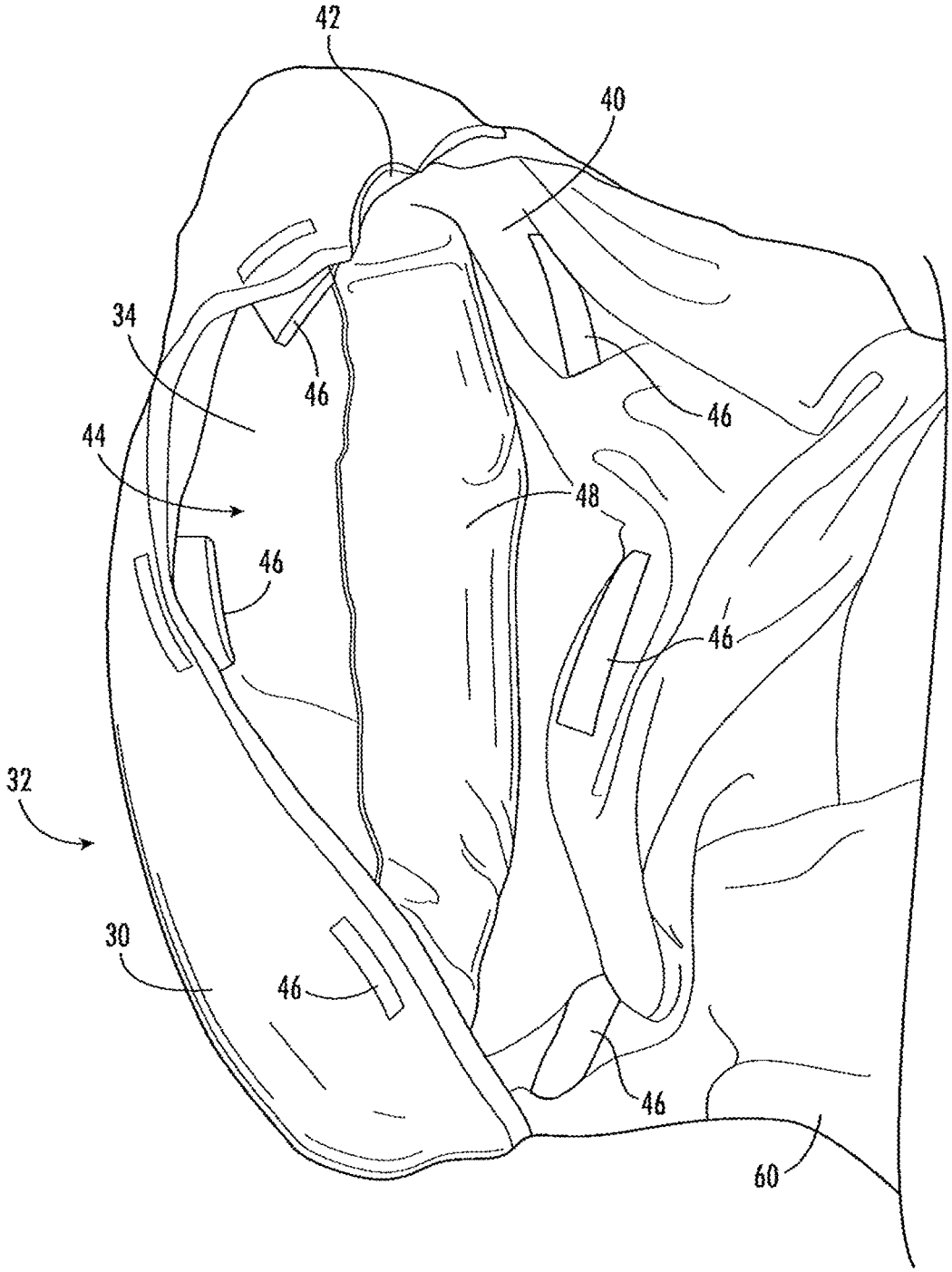
FIG. 3 shows a perspective view of one end of the combination pillow and blanket system of FIG. 1 in an opened state, showing the pillow cavity and insert.

Referring to FIG. 3, the pillow case 32 includes an interior surface 40 opposite the top surface 28 and an interior surface 42 opposite the bottom surface 30. A slit 44 is formed along one of the longitudinal edges 36. A fastener 46 is adapted for releasably sealing the slit 44. The fastener 46 may consists of at least one hook and loop fastener, a zipper, at least one snap button, or the like.

A cushioning element 48 is located within the compartment 34. The cushioning element 48 may consist of a pillow insert, pancake pillow, down feather or the like. The cushioning element 48 may be a washable item.

The first handle 16 is located at one of the side edges 38 of the first section 22 and the second handle 18 is located at the other side edge 38. The first attachment mechanism 12 is located at one of the side edges 38 of the first section 22 and the second attachment mechanism 14 is located at the other side edge 38 and aligned with the first attachment mechanism 12, wherein with the first section 22 folded in half with the two side edges 38 adjacent one another, the first and second attachment mechanisms 12, 14 are releasably secured together. The first and second attachment mechanism 12, 14 of the first section 22 may be a snap button, a hook and loop fastener, or similar item.

The second or mid-section 24 includes a top surface 58 and bottom surface 60. The mid-section 24 generally defines two longitudinal edges 62 and two side edges 64, the mid-section 24 extends from the first section 22 along respective longitudinal edges 36, 62, the mid-section 24 is made of a blanket material or similar fabric.

The third section 26 includes a top surface 66 and bottom surface 68. The third section 26 generally defines two longitudinal edges 70 and two side edges 72. The third section 26 extends from the mid-section 24 along a border 74 formed by respective longitudinal edges 62, 70. The third section 26 is made of a blanket material or similar fabric. At least one slit 76 is formed in an area of the border 74.

In one embodiment, the top surface and bottom surface of the first section 22, the mid-section 24 and the third section 26 may be formed of a continuous layer of fabric material. However, the invention anticipates that the material for each section may not be the same. One or more slits 76 may be formed generally along the border 74. The slit 76 may or may not extend entirely along the border 74.

At least one first attachment mechanism 78 is located at the longitudinal edge 62 of the mid-section 24 and at least one second attachment mechanism 80 is located at the longitudinal edge 70 of the third section 26, and aligned with a respective first attachment mechanism 78, wherein respective first and second attachment mechanisms 78, 80 are releasably secured together, whereby a slit 76 is adjustably formed by a user between attachment mechanisms 78, 80 along the border 74 formed by the longitudinal edge 62 of the mid-section 24 which meets with the longitudinal edge 70 of the third section 26. The first and second attachment mechanisms 78, 80 of the at least one slit 76 may consists of a snap button, a hook and loop fastener or similar mechanism.

The shoulder strap 20 includes a first end 82 with a first clip 84 and a second end 86 with a second clip 88, the first clip 84 and second clips 86 are adapted to connect to either of the first handle 16 and the second handle 18. The shoulder strap includes an adjustable band 90. In another embodiment, there is a second set of handles (not shown) located in the area of the respective side edges 38. The second set of handles may be smaller in the form of a loop and intended for the shoulder strap 20 to be connected to the second set of handles or loops, wherein the handles 16, 18 remain free of the shoulder strap 20.

The system 10 in the unfolded state has an overall length formed by the side edges 38, 64, 72, and the length of the side edges 38 of the first section 22 is approximately one third of the overall length, and the length of the side edges 64 of the mid-section 24 is approximately one third of the overall length, and the length of the side edges 72 of the third section 26 is approximately one third of the overall length.

The overall length may be in the range from approximately 24 inches to 36 inches, with the edges 36; 62; 70 in the range from approximately 40 inches to 75 inches. In one embodiment, the overall length in the open state is approximately 48 inches and the edges 36; 62 or width is approximately 24 inches.

In use, the system 10 may be used as a lap blanket while reclining, working, and traveling or the like. The arms of a user may extend through the slits 76 so as to use a lap top, cell phone or conduct other activities as desired. The system 10 may even be used while on a conference call without being seen. The system 10 folds up and snaps together with the shoulder strap 20 and handles 16, 18 for ready travel.

The invention claimed is:

1. A combination pillow and blanket system, the system comprising:

a first section having a top surface and a bottom surface and includes a pillow case forming a compartment, the first section defines two longitudinal edges and two side edges, the pillow case includes a slit formed along one of the edges, a fastener is adapted for releasably sealing the slit, a cushioning element is located within the compartment, a first handle is located at one of the side edges and a second handle is located at the other side edge, a first attachment mechanism is located at one of the side edges and a second attachment mechanism is located at the other side edge and aligned with the first attachment mechanism, wherein with the first section folded in half with the two side edges adjacent one another, the first and second attachment mechanisms are releasably secured together;

a second or mid-section having a top surface and bottom surface, the mid-section defines two longitudinal edges and two side edges, the mid-section extends from the first section along respective longitudinal edges, the mid-section is made of a blanket material;

a third section having a top surface and bottom surface, the third section defines two longitudinal edges and two side edges, the third section extends from the mid-section along respective longitudinal edges, the third section is made of a blanket material; and at least one slit is formed in an area where the mid-section and third section meet.

2. The combination pillow and blanket system of claim 1, wherein the first and second attachment mechanism of the first section is a snap button.

3. The combination pillow and blanket system of claim 1, wherein the first and second attachment mechanism of the first section consists of a hook and loop fastener.

4. The combination pillow and blanket system of claim 1, wherein the at least one slit is formed along a border formed by the longitudinal edge of the mid-section which meets with the longitudinal edge of the third section.

5. The combination pillow and blanket system of claim 4, wherein at least one first attachment mechanism is located at the longitudinal edge of the mid-section and at least one second attachment mechanism is located at the longitudinal edge of the third section, and aligned with a respective first attachment mechanism, wherein respective first and second attachment mechanisms are releasably secured together, whereby a slit is formed between attachment mechanisms along the border formed by the longitudinal edge of the mid-section which meets with the longitudinal edge of the third section.

6. The combination pillow and blanket system of claim 4, wherein the first and second attachment mechanisms of the at least one slit consists of a snap button.

7. The combination pillow and blanket system of claim 4, wherein the first and second attachment mechanisms of the at least one slit consists of a hook and loop fastener.

8. The combination pillow and blanket system of claim 1, further comprising a shoulder strap having a first end with a first clip and a second end with a second clip, the first clip is adapted to connect to the first handle and the second clip is adapted to connect to the second handle.

9. The combination pillow and blanket system of claim 1, wherein the top surface of the first section and the mid-section are formed of a continuous layer of fabric material.

10. The combination pillow and blanket system of claim 1, wherein the top surface and bottom surface of the first section and the mid-section are formed of a continuous layer of fabric material.

11. The combination pillow and blanket system of claim 1, wherein the cushioning element is selected from a pillow insert, pancake pillow, and down feather.

12. The combination pillow and blanket system of claim 1, wherein the system in an unfolded state measures in the range of 24 to 36 inches by 40 to 75 inches.

13. The combination pillow and blanket system of claim 1, wherein the system in an unfolded state has an overall length formed by the side edges, and the length of the side edges of the first section is one third of the overall length, and the length of the side edges of the mid-section is one third of the overall length, and the length of the side edges of the third section is one third of the overall length.

14. The combination pillow and blanket system of claim 1, wherein the fastener adapted for releasably sealing the slit consists of a hook and loop fastener.

15. The combination pillow and blanket system of claim 1, wherein the fastener adapted for releasably sealing the slit consists of a zipper.

16. The combination pillow and blanket system of claim 1, wherein the fastener adapted for releasably sealing the slit consists of at least one snap button.

* * * * *